US006213642B1

(12) United States Patent
Jensen

(10) Patent No.: US 6,213,642 B1
(45) Date of Patent: Apr. 10, 2001

(54) PAPER BAG WITH TEAR STRIP HAVING INDICIA

(75) Inventor: Kurt Jensen, Lebanon, OH (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/364,942

(22) Filed: Jul. 30, 1999

(51) Int. Cl.[7] ..... B65D 30/00

(52) U.S. Cl. ..... 383/127; 383/111; 383/125; 229/70

(58) Field of Search ..... 383/111, 127, 383/125, 126; 229/70, 928

(56) References Cited

U.S. PATENT DOCUMENTS

| | | | | |
|---|---|---|---|---|
| 2,260,064 | | 10/1941 | Stokes . | |
| 2,347,075 | * | 4/1944 | Berkowitz | 229/70 |
| 2,614,349 | * | 10/1952 | Barnes | 383/111 |
| 2,867,372 | | 1/1959 | Fox . | |
| 3,183,614 | * | 5/1965 | Loderhose . | |
| 3,220,634 | | 11/1965 | Rubinstein . | |
| 3,744,383 | * | 7/1973 | Finch et al. | 383/127 X |
| 3,761,013 | | 9/1973 | Schuster . | |
| 3,804,323 | | 4/1974 | Bemel . | |
| 3,979,049 | * | 9/1976 | Achelpohl | 383/125 |
| 3,998,135 | | 12/1976 | Sargent . | |
| 4,306,357 | | 12/1981 | Otto . | |
| 4,485,926 | * | 12/1984 | Lenzmeier . | |
| 4,537,586 | * | 8/1985 | Gale et al. | 383/127 X |
| 5,007,578 | | 4/1991 | Simane . | |
| 5,009,518 | | 4/1991 | Faltynek . | |
| 5,025,980 | * | 6/1991 | Blackman | 229/70 X |
| 5,035,515 | * | 7/1991 | Crossman et al. | 229/70 X |
| 5,100,180 | * | 3/1992 | Tucker | 229/70 X |
| 5,163,756 | * | 11/1992 | Riseman | 383/127 |
| 5,464,285 | | 11/1995 | Anderson . | |
| 5,613,312 | | 3/1997 | Crowell . | |
| 5,836,095 | | 11/1998 | Crowell . | |
| 6,041,929 | * | 3/2000 | Brunner et al. | 383/111 X |

FOREIGN PATENT DOCUMENTS

| | | | | |
|---|---|---|---|---|
| 506757 | * | 10/1954 | (CA) | 383/32 |
| 709750 | * | 6/1954 | (GB) | 383/111 |
| 2074541 | * | 11/1981 | (GB) | 383/127 |
| 8904279 | * | 5/1989 | (WO) | 383/127 |

* cited by examiner

*Primary Examiner*—Allan N. Shoap
*Assistant Examiner*—Robin A. Hylton
(74) *Attorney, Agent, or Firm*—Michael J. Doyle

(57) ABSTRACT

A paper bag formed from a unitary blank and having a longitudinal seam running along its length. The seam is of a double layer of paper and has two spaced and parallel adhesive areas joining the two layers. A pair of parallel perforated lines border respective adhesive areas. The perforated lines define a tear strip on the outermost one of the double layers. The tear strip is provided on its usually hidden surface with indicia, so that after tearing it away, the user will be notified by the indicia of the winning of a prize offered by the vendor of product placed within the bag.

7 Claims, 3 Drawing Sheets

PAPER BAG WITH TEAR STRIP HAVING INDICIA

BACKGROUND OF THE INVENTION

This invention relates to a paper bag construction particularly adapted for the packaging of fast foods. The bag is provided with a tear strip running along its length. The tear strip is provided on one of its sides or surfaces with indicia, so that upon tearing off the strip, the consumer of the product (such as a hamburger sandwich) will see the indicia.

While tear strips for various containers are known, the former are usually employed for ripping open the container to enable access to the product by the consumer. Typical known tear strip constructions thus destroy the integrity of the container upon tearing.

SUMMARY OF THE INVENTION

According to the practice of this invention the right and left ends of the rectangular, unitary paper blank from which the bag is formed are overlapped to form a tube, as usual. Other and central portions of the blank, along one edge thereof, form an end closure for the tube, the end closure being the bag bottom. Two spaced and parallel adhesive areas at the right blank end, for example, are folded onto a corresponding left blank end zone. The resultant overlapped blank ends form a double thickness seam running longitudinally of the bag. The seam is defined by two parallel and spaced apart adhesive zones or areas. One border of each adhesive area includes a perforated line, the result being the area between the perforated lines and adhesive areas defines a tear strip. The underside of the tear strip is provided with indicia, to thereby indicate the winning or not winning of a prize offered by the vendor of the fast food. The consumer may tear off the tear strip, either completely or just enough to note the indicia, without injuring or ripping the interior surface of the bag. The tear strip overlaps a contiguous portion of the interior bag surface, so that upon ripping up the strip, this contiguous portion (being a part of the bag interior surface) is undisturbed.

DETAILED DESCRIPTION OF THE INVENTION

Figure 1:
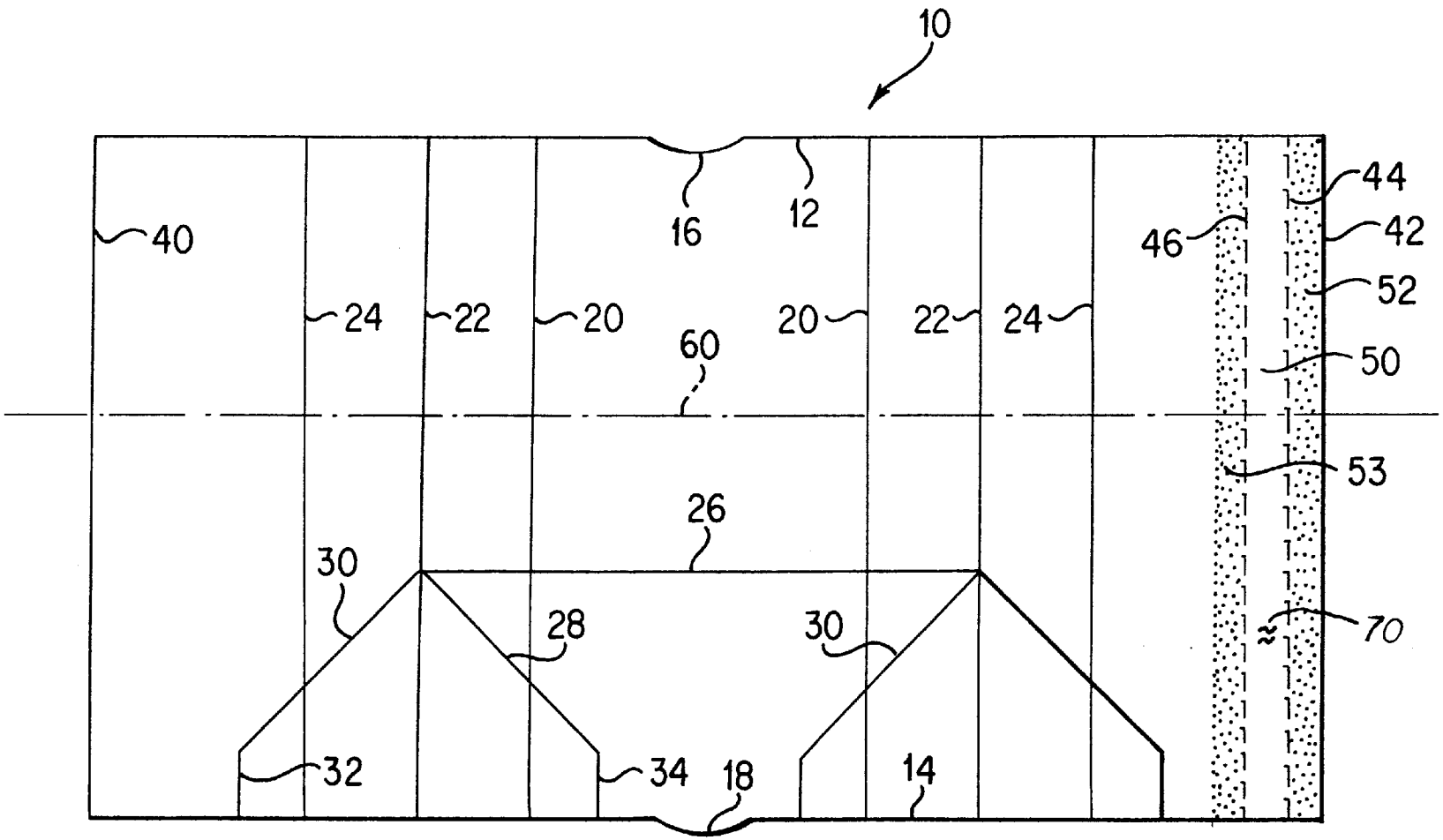
FIG. 1 is a plan view of a unitary paper blank, scored as indicated, provided with parallel adhesive areas at its right end.

Referring now to FIG. 1 of the drawings, a unitary and rectangular blank of paper is denoted as 10, having an upper edge 12 and a lower edge 14. A conventional recess 16 and protuberance 18 may, optionally, be provided, these two elements having no bearing on the invention. Two sets of vertically running score/fold lines 20, 22, 24 run from the top to the bottom blank edge. Bag bottom forming score/fold lines 26, 28, 30, 32 are provided in the lower central area of the blank, these lines being conventional and not significant to the practice of the invention. Alternatively, the blank may be configured yield a conventional pinch bottom type bag.

The left and right hand edges of the blank are denoted, respectively, as 40 and 42. A pair of parallel perforated lines is provided adjacent the right blank end, denoted as 44 and 46. A first adhesive zone is denoted as 52, while a second adhesive area or zone is denoted as 53. A tear strip 50 is defined as that area of blank 10 located between perforated lines 44 and 46. Tear strip 50 is provided with indicia 70 on that side or surface thereof which is remote from the viewer of the blank of FIG. 1. Similarly, the adhesive on areas 52 and 53 is on that surface of the blank remote from the viewer. A reference longitudinal axis is denoted as 60.

The blank is now folded and a double thickness seam formed by the overlapping of the right and left edges of the blank. The reader may imagine the center of the blank to be lifted up and both left and right edges moved down, away from the plane of the paper. In practice, such folding is carried out by automatic machinery, known in this art, and forming no part of the invention. Such folding produces a tube like structure closed at one end by the bag bottom fold lines 26, 28, 30, 32, 34. The finished bag is folded flat until its use.

Figure 4:
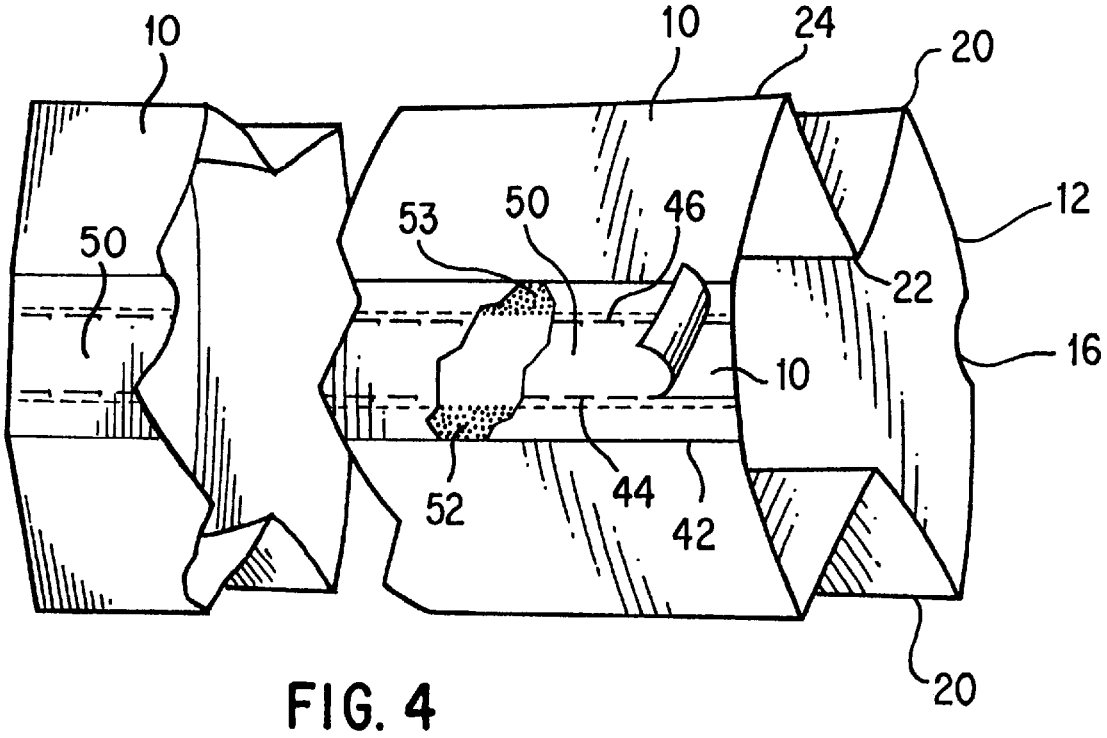
FIG. 4 is a partial, perspective view of a paper bag formed from the blank of FIG. 1, with its tear strip partially ripped away.

FIG. 4 illustrates the open end (remote from the bag bottom) of the bag, with the right end of the blank overlying the left end. The indicia is located on that tear strip surface facing away from the viewer of FIG. 4. Alternatively, the indicia may be provided on the outer surface of the inner ply of the side seam, being that surface which is beneath tear strip 50. The end of the tear strip is shown as partially torn or ripped down towards the bag bottom. Such ripping does not impair the integrity of the bag interior surface, as may be seen from FIG. 4 where that part of the bag interior surface beneath strip 50 is shown as still intact and undisturbed after ripping of the strip. Adhesive areas 52 and 53 typically are provided with the same quantity and kind of adhesive, the result being that both perforated lines 44 and 46 must be torn or ruptured to pull up the tear strip.

Figure 2:
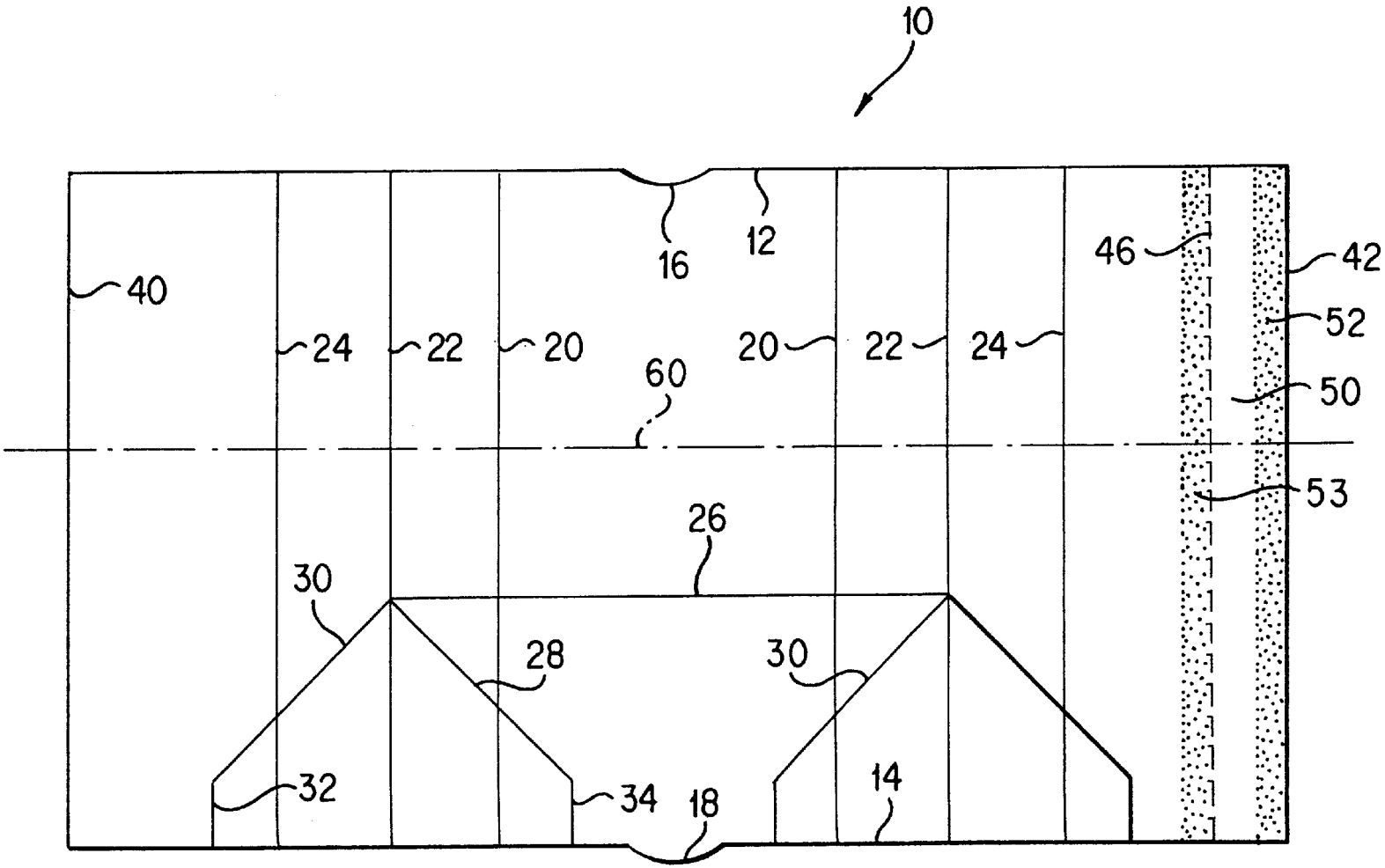
FIG. 2 is a plan view of a similar blank, and shows a second embodiment.

Referring now to FIG. 2 of the drawings, a blank for making a second embodiment of the invention is shown. The difference between the two blanks is that the blank of FIG. 2 lacks the first perforated line 44, and that the amount of adhesive on area 52 is less than that on area 52 of the blank of FIG. 1. Alternatively, a peelable adhesive may be used on area 52 of the blank of FIG. 2, or, the adhesive pattern on area 52 may be varied to permit its ready separation from the panel to which it is adhered.

Figure 3:
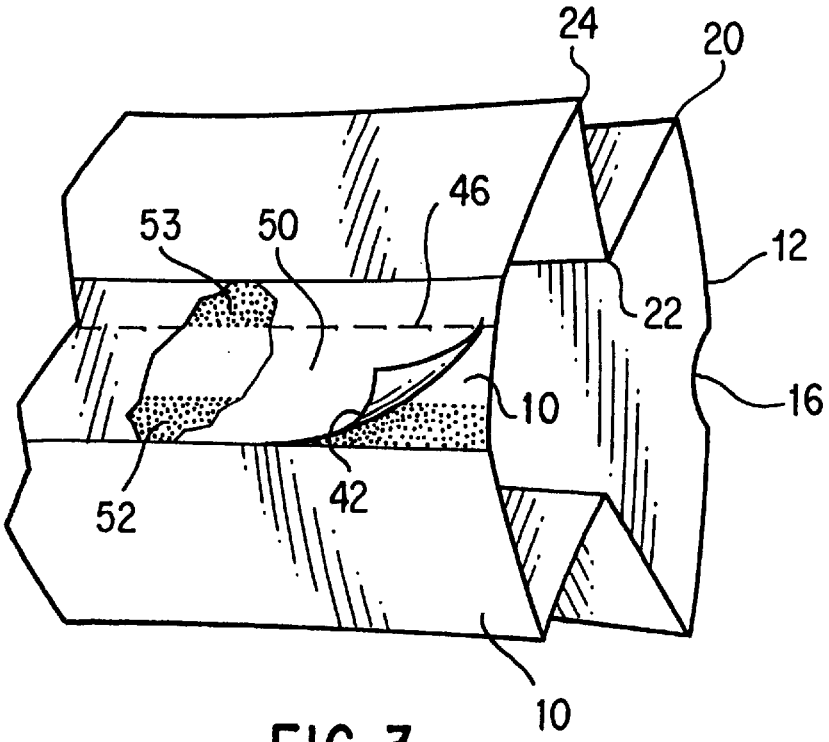
FIG. 3 is a partial, perspective view of a paper bag formed from the blank of FIG. 2, with its tear strip partially ripped away.

FIG. 3 illustrates the ripping of the tear strip of a paper bag formed from the blank of FIG. 2. There, because the amount of adhesive on area 52 is less, the user can commence the tearing by simply grasping a corner of the tear strip and pulling upwardly, separating the tear strip from adhesive surface 52 without ripping the paper. With continued pulling, the tear strip will begin to rip along perforated line 46, thereby exposing the indicia on the side of the tear strip remote from the viewer. In FIG. 3, the stippling (used to denote adhesive) of the right hand adhesive area or zone 52, is shown as on the left end or edge of the paper. This is done for purposes of illustration to show the adhesive location in the completed bag. In practice, using the blank of FIG. 2, this adhesive would be originally located on tear strip 50.

In both embodiments, the adhesive placement may be reversed, namely, adhesive may be placed on the left end of the blank instead of on the right end. In both embodiments, the seam is defined by a double layer of the paper, each layer from a respective blank end. One layer is the radially outermost (referred to the bag interior) layer and having the tear strip and the other layer is the radially innermost and on the interior surface of the bag. It is readily seen that a flat bottom bag or a pinch bottom bag may be employed in carrying out the invention.

What is claimed is:

1. A paper blank for forming a foldable paper bag which, when opened, is in the general form of a tube closed at one end, said blank being generally rectangular in outline, an imaginary axis running longitudinally of said blank, said blank having an upper edge, a lower edge, and right and left edges, a plurality of spaced fold lines each transverse to said longitudinal axis, first and second parallel, perforated lines each running transversely of said longitudinal axis, said first and second parallel, perforated lines forming a tear strip therebetween, a first adhesive zone of said blank located between one of said right and left edges and said first perforated line, a second adhesive zone of said blank located adjacent said second perforated line and remote from said first adhesive zone and parallel to said first adhesive zone, wherein when said blank is folded to form a tube, two spaced adhesive seams are formed by said first and second adhesive zones and said tear strip can be torn away without destroying the integrity of the internal surface of a bag formed from said blank.

2. The blank of claim 1 wherein said tear strip carries indicia which is not visible until said tear strip is torn away.

3. The blank of claim 2 wherein said paper is opaque.

4. The blank of claim 1 wherein said two adhesive zones are on the same surface of said blank.

5. A paper bag in the form of a tube and having a bottom, said bag formed from a generally rectangular unitary paper blank, said bag having a seam defined by two parallel and spaced apart elongated adhesive areas, said seam having two overlapped layers of said paper, one of said overlapped layers being on the radially outermost part of said seam and the other layer being on the radially innermost part of said seam, said two layers defined by respective opposite ends of said blank, two parallel and spaced apart perforated lines on said radially outermost layer, said perforated lines defining a tear strip therebetween, each said perforated line located adjacent and bordering a respective said adhesive area, whereby when said tear strip is torn away and ripped down towards the bag bottom, said radially innermost seam layer of said bag is not torn or damaged.

6. The bag of claim 5 wherein said tear strip has a usually hidden surface which is provided with indicia.

7. The bag of claim 5 wherein said radially innermost layer of said seam carries indicia, said indicia located beneath said tear strip.

* * * * *